US005758589A

United States Patent [19]

Pommier

[11] Patent Number: 5,758,589

[45] Date of Patent: Jun. 2, 1998

[54] PLASTIC CLOSURE ELEMENTS FOR GARMENTS, METHOD AND APPLICATION

[75] Inventor: Jean-Claude Pommier, Sassenage, France

[73] Assignee: A. Raymond & Cie., France

[21] Appl. No.: 535,456

[22] Filed: Sep. 28, 1995

[30] Foreign Application Priority Data

Oct. 1, 1994 [DE] Germany ..... 44 35 320.0

[51] Int. Cl.[6] ..... D05B 35/00

[52] U.S. Cl. ..... 112/107; 112/475.14; 24/689; 24/695

[58] Field of Search ..... 112/475.14, 475.15, 112/475.16, 104, 105–108, 110, 113, 235, 240; 24/113, 375, 588, 694, 695, 687, 907, 692; 264/161, 138, 5, 13, 454, 216, 33, 238; 206/716

[56] References Cited

U.S. PATENT DOCUMENTS

| | | | |
|---|---|---|---|
| 857,731 | 6/1907 | Granger | 112/107 |
| 2,207,077 | 7/1940 | Stott | 112/113 |
| 2,964,171 | 12/1960 | Chadwick | 206/716 |
| 3,013,308 | 12/1961 | Armour | 264/238 |
| 3,023,422 | 3/1962 | Shular | 24/695 X |
| 3,143,092 | 8/1964 | Glassman et al. | 112/235 X |
| 3,774,756 | 11/1973 | Carlile et al. | 24/698 X |
| 3,858,538 | 1/1975 | Van Amburg | 112/235 |
| 3,993,009 | 11/1976 | Osaki | 112/235 |
| 5,163,552 | 11/1992 | Thuswaldner | 24/689 X |

*Primary Examiner*—Ismael Izaguirre

*Attorney, Agent, or Firm*—Gifford, Krass, Groh, Sprinkle, Patmore, Anderson & Citkowski,P.C.

[57] ABSTRACT

A mounting assembly for mounting plastic closure elements or snaps on fabric includes a pair of parallel holding bars. Rows of closure elements are formed between the holding bars. The mounting assembly is positioned on the fabric and a sewing machine having a slide with a pair of guide bars is positioned over the holding bars. The holding bars of the mounting assembly provide a track for the sewing base during the stitching process. The base portions of the closure elements are stitched onto the fabric. After stitching the holding arms are torn off the closure elements and discarded. The sewing base includes a pair of guide bars for guiding the sewing base along the holding bars.

5 Claims, 2 Drawing Sheets

PLASTIC CLOSURE ELEMENTS FOR GARMENTS, METHOD AND APPLICATION

BACKGROUND OF THE INVENTION

I. Field of the Invention

The present invention relates to plastic closure elements which may be snapped together for fastening textiles or fabrics together, and an apparatus and method for fastening the closure elements to garments.

II. Description of the Prior Art

Plastic closure elements for fastening garments of elastically stretchable material such as body suits or other similarly close-fitting articles of clothing are well known. These plastic closures include male and female elements which are pushed or snapped together. The closure elements or "snaps" are formed of a hard but deformable plastic material and include a base plate which is perforated for sewing onto a fabric band. The closure elements have interlocking male and female fastening portions such as a cone and crown extending from the base plates. The closure elements are typically sewn onto a perforated fabric band. The fabric band is perforated to ensure that the closure elements are centered on the band and to maintain the desired spacing between the closure elements. The male and female closure elements are then individually positioned in the perforations on the fabric band. The cone and crown portion of the closure elements are inserted through the perforations and held in position during the sewing process. After the closure elements are stitched onto the fabric band, the band is then sewn in place on the article of clothing.

Because it is expensive and complicated to sew on a separate fabric band, attempts have been made to sew the closure elements directly onto the article of clothing by using a centering template. However, because the elastic material is subjected to pull during stitching, the holes for the closure elements are elongated occasionally releasing the elements from the clothing material. Additionally, there are problems in aligning and maintaining the elements along the center axis as well as problems in handling the material.

It is the object of the present invention to provide an economic method and device permitting the sewing of closure elements or snaps directly onto elastically stretchable textile material while providing perfect alignment and the intended spacing between the closure elements.

SUMMARY OF THE INVENTION

Accordingly, the present invention is directed to a mounting assembly permitting sewing of closure snaps directly onto a garment. Also disclosed is a method and apparatus for use in the stitching process. The mounting assembly includes a row of spaced apart closure elements supported between two parallel holding bars. The holding bars are connected to a base plate of each closure part by cross arms formed to be torn from the base plate of each of the closure elements.

To mount the closure elements on a garment, the mounting assembly is placed on the garment with the clothing elements in the desired location on the garment. After the mounting assembly is positioned on the garment, one end of the mounting assembly is pushed under a sewing base of a sewing machine. The sewing base has a slide plate which presses the two holding bars, together with the base plates of the closure elements, against the fabric. This prevents pulling or stretching of the elastic material. The sewing machine then stitches the closure elements onto the fabric while the sewing base rides along the holding bars. After the sewing base has passed over the holding bars and the base plates of the closure elements have been sewn onto the material, a simple pull on the ends of the holding bars is sufficient to tear the holding bars from the closure elements leaving the closure elements on the fabric.

The holding bars and connecting cross arms are formed by the mold channels utilized in injecting the mold cavities. The channels are dimensioned in such a way as to form holding bars which may be utilized as guides during the sewing of the base plates.

The sewing base of the sewing machine has a pair of stitching passages and a support member which extends between two guide bars. The spacing of the guide bars is such that during the stitching process the guide bars slide along the outside of the holding bars of the mounting assembly. Between the support surface is a transverse central channel having a width and height sufficient to permit the sewing base to pass freely over the cones and crowns of the closure elements.

BRIEF DESCRIPTION OF THE DRAWINGS

Other objects, features and advantages of the present invention will be apparent from the written description of the drawings in which.

DETAILED DESCRIPTION OF THE PREFERRED EMBODIMENT

Figure 1:
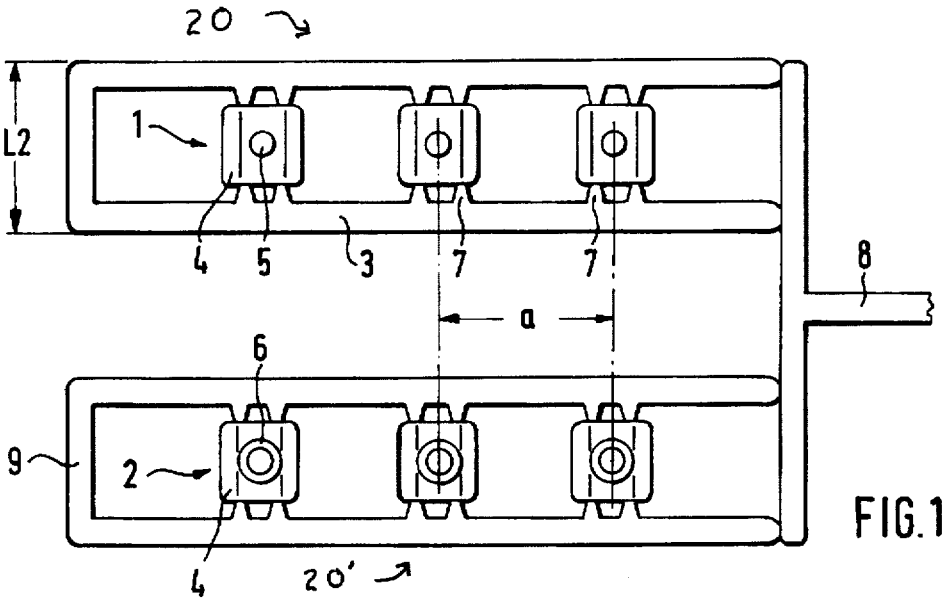
FIG. 1 is a plan view of the assembly with male and female closure elements formed according to the invention.
Figure 2:
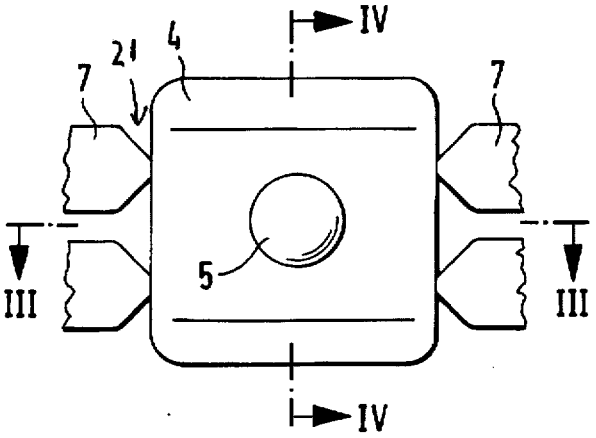
FIG. 2 is an enlarged plan view of a male closure element supported by cross arms.

Shown in FIG. 1 is improved mounting assemblies 20,20' for mounting closure elements or snaps directly onto a garment or fabric. The mounting assembly 20 includes crown or male closure parts 1 and the mounting assembly 20' includes a row of female closure parts 2 which are connected to pairs of holding bars 3. The closure elements 1 and 2 in each row are spaced apart from each other by a predetermined distance "a". The closure elements are held in the spacing by pairs of cross arms 7. As best shown in FIG. 2, the cross arms 7 are formed with indentations which permit the holding bars 3 and cross arms 7 to be readily torn or separated from the closure elements 1 and 2.

Figure 3:
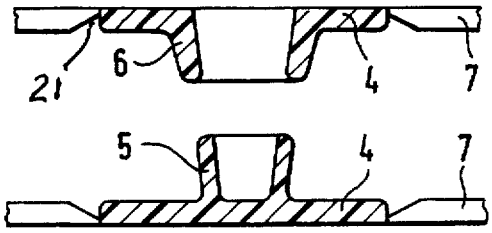
FIG. 3 is a partial cross-sectional view of a male and female closure element positioned for assembly taken along line III—III in FIG. 2.
Figure 4:
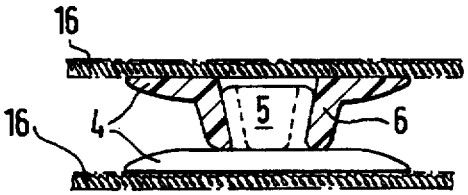
FIG. 4 is a cross-sectional view of a male and female closure element closed together and mounted on fabric.
Figure 5:
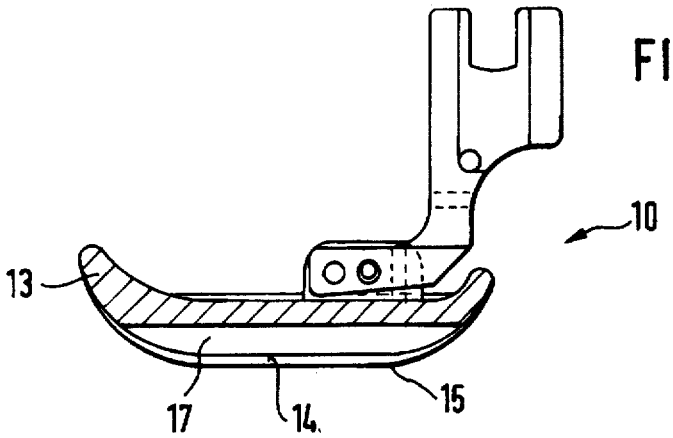
FIG. 5 is a sectional side view of a sewing base taken along line V—V of FIG. 7.
Figure 6:
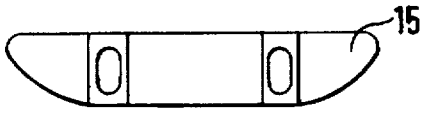
FIG. 6 is a side view of the sewing base showing the guide edges.
Figure 7:
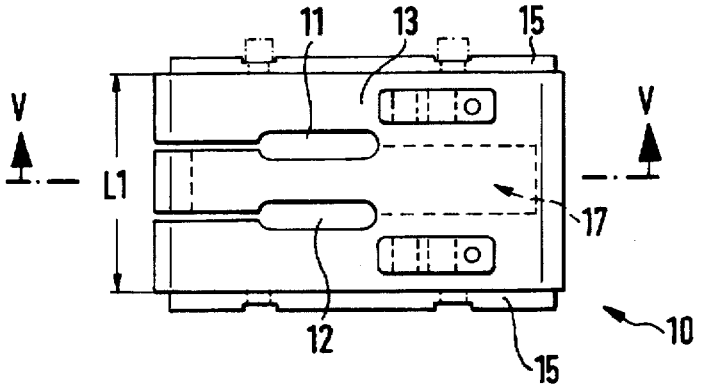
FIG. 7 is a plan view of the support surface of the sewing base.

As best shown in FIGS. 3 and 4, the male closure element 1 includes a generally square base plate 4 with an inverted frusto-conical shaped connecting portion or cup 5 which is adapted to be received within an opening of a complementary connecting portion or crown 6 extending from a base plate 4 of the female closure element 2. As is known, the connecting portions of the closure elements may be pushed or snapped together and released when desired by pulling the elements apart.

As shown in FIG. 1, assembly 20 is unitarily formed by multi-celled injection molding of a plastic material. The holding bars 3 and cross arms 7 are formed in the mold channels which are provided for injection of the plastic material. The channels are fed with plastic material from the main feed channel 8 of the injector. The outer ends of holding bars 3 are advantageously joined by a transverse bar 9 which provides additional strength to the holding bars 3 and prevents inadvertent removal of the closure elements 1 and 2 from cross arms 7.

In order to sew the closure elements onto the fabric, a novel sewing base 10 is provided as shown in FIGS. 5 through 8. The sewing base 10 is provided with a pair of openings 11 and 12 provided for the passage of sewing needles. The sewing base 10 is mounted onto a conventional industrial sewing machine in a usual fashion. Sewing base 10 includes a slide member 13 having a pair of support surfaces 14. A pair of spaced apart guide bars 15 are mounted to the slide member 13 adjacent a respective support surface 14. The spacing "L1" between the two guide bars 15 (FIG. 7) is dimensioned in such a way that it corresponds to the outer width "L2" of the holding bars 3. (FIG. 1) The guide bars 15 have straight edges and extend from the support surfaces 14 only as far as necessary to maintain position on the holding bars 3 without penetrating into the material fabric 16.

Figure 8:
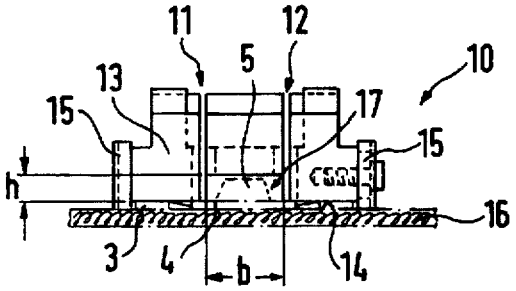
FIG. 8 is a front elevation of the sewing base.

The slide member 13 has a central channel 17 which has a width "b" and a height "h" dimensioned in such a way that the slide member 13 can pass freely over the cones 5 and crowns 6 of the closure elements 1 or 2 during sewing of the base plates 4 to the fabric 16 as shown in FIG. 8.

The method of attachment includes placing the mounting assembly 20 or the mounting assembly 20', including a holding bars 3 and transverse bar 9, in the desired position on the fabric 16. The sewing base 10 is then positioned on the end of the holding bars 3 joined by the transverse bar 9. The guide bars 15 of the sewing base are positioned on the outside of the holding bars 3. The sewing machine is then operated to permit the sewing base to glide along the holding bars 7 while the sewing machine is being operated.

Base plate 4 may be perforated for the needles or unperforated provided that the material and thickness of the base plates 4 is chosen in such a way that the sewing needles can pass through without problem. After stitching is completed, the holding bars 3 are grasped at one end, preferably adjacent to transverse bar 9, and are separated from the base plates 4 by pulling the holding bars 3 and cross arms 7 from the base plates. The holding bars 7 are then discarded and thus is provided a novel economic method of attaching closure elements to fabric.

Having best described my invention, one skilled in the art will readily recognize from such discussion, and from the accompanying drawings and claims, that various changes, modifications and variations can be made therein without departing from the spirit and scope of the invention as defined in the following claims.

I claim:

1. An assembly for sewing of a plurality of male closure elements and a plurality of female closure elements to a fabric by a sewing machine, said assembly comprising:

said plurality of male closure elements uniformly formed between a first pair of parallel holding bars, each of said plurality of male closure elements having a base plate and a connecting portion extending outwardly from said base, said plurality of female closure elements uniformly formed between a second pair of parallel holding bars, each of said female closure elements having a base plate and a receiving portion adapted to receive said connecting portion of a respective one of said plurality of male closure elements.

each one of said plurality of male and female closure elements being positioned a predetermined distance from an adjacent closure element by a cross arm extending from each of said first and second pairs of holding arms, each of said cross arms having a portion formed to permit removal of the holding arms from the closure elements by tearing.

2. The assembly of claim 1 wherein said pair of holding bars and said cross arms are formed by a channel delivering molten plastic material to a plurality of mold cavities.

3. The assembly of claim 1, wherein said first and second pairs of parallel holding bars are spaced an equal predetermined distance apart.

4. A sewing base for a sewing machine having a pair of needles for use in sewing a plurality of closure elements having a connecting portion, said plurality of closure elements supported on a mounting assembly having a pair of parallel holding bars, said sewing base comprising:

a slide member having a top surface and a pair of spaced apart support surfaces and a center channel therebetween, said channel having a predetermined width and height for freely accepting said connecting portion of said closure elements, a pair of spaced apart parallel openings extending through said top surface into said center channel and adapted to receive respective ones of said pair of needles; and a pair of guide bars mounted to said slide member spaced apart a predetermined distance to accept said pair of holding bars therebetween.

5. A method of sewing a plurality of closure elements to a fabric, said method comprising the steps of:

molding a mounting assembly having a row of said closure elements supported by a pair of holding bars;

positioning said mounting assembly on said fabric;

guiding a sewing base of a sewing machine along said pair of holding bars while stitching said closure elements; and tearing said holding bars from said closure elements after said stitching.

* * * * *

UNITED STATES PATENT AND TRADEMARK OFFICE

CERTIFICATE OF CORRECTION

PATENT NO. : 5,758,589

DATED : June 2, 1998

INVENTOR(S) : Jean-Claude Pommier

It is certified that error appears in the above-indentified patent and that said Letters Patent is hereby corrected as shown below:

Claim 1, Column 4, line 15, delete "." and insert --,--;

Column 2, line 56, after "indentations", insert --21--.

Signed and Sealed this

Eighth Day of September, 1998

*Attest:*

Bruce Lehman

BRUCE LEHMAN

*Attesting Officer*

*Commissioner of Patents and Trademarks*